US006869163B2

(12) United States Patent
Nakashima

(10) Patent No.: US 6,869,163 B2
(45) Date of Patent: Mar. 22, 2005

(54) INK-JET RECORDING APPARATUS

(75) Inventor: Atsuhisa Nakashima, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/440,187

(22) Filed: May 19, 2003

(65) Prior Publication Data

US 2003/0218652 A1 Nov. 27, 2003

(30) Foreign Application Priority Data

May 21, 2002 (JP) ..... 2002-145580

(51) Int. Cl.[7] ..... B41J 2/165
(52) U.S. Cl. ..... 347/31; 347/35
(58) Field of Search ..... 347/22–36

(56) References Cited

U.S. PATENT DOCUMENTS

| | | | | |
|---|---|---|---|---|
| 4,839,667 A | | 6/1989 | Murakami et al. | 347/220 |
| 5,517,222 A | * | 5/1996 | Sugiyama et al. | 347/35 |
| 6,652,170 B1 | * | 11/2003 | Arnold | 400/88 |

FOREIGN PATENT DOCUMENTS

| | | |
|---|---|---|
| EP | 0 707 973 A2 | 4/1996 |
| JP | A 63-160850 | 7/1988 |
| JP | A 63-205258 | 8/1988 |
| JP | A 5-31931 | 2/1993 |
| JP | 07009712 | 6/1993 |
| JP | A 5-286129 | 11/1993 |
| JP | A 7-9712 | 1/1995 |
| JP | A 9-174968 | 7/1997 |
| JP | B2 2792659 | 6/1998 |
| JP | A 2001-71521 | 3/2001 |
| WO | WO 02/22368 | 3/2002 |

OTHER PUBLICATIONS

Partial European search report, Zacchini, D; Jul. 7, 2004, p. 1/2

* cited by examiner

*Primary Examiner*—Shih-Wen Hsieh
(74) *Attorney, Agent, or Firm*—Oliff & Berridge, PLC

(57) ABSTRACT

An inkjet recording apparatus is provided with an inkjet head having nozzles. The ink is ejected from the nozzles to recording medium. A platen is arranged close to the inkjet head so as to face the inkjet head. The platen has a rotatable cylindrical body. A porous layer is provided at least a surface of the cylindrical body to absorb ink ejected from the nozzles to the cylindrical body. Alternatively, the surface of the cylindrical body is configured to repel the ink, and a cleaning structure is provided to remove the ink applied on the surface of the cylindrical body.

24 Claims, 7 Drawing Sheets

INK-JET RECORDING APPARATUS

BACKGROUND OF THE INVENTION

The present invention relates to an inkjet recording apparatus, and more particularly to an inkjet recording apparatus having a so-called linear inkjet head provided with continuously arranged ink ejecting nozzles in a width direction of a recording medium.

Recently, inkjet printers have been widespread since they generate less noise, and standard paper can be used as recording medium. A conventional inkjet printer typically employs an inkjet head which sweeps in a width direction (main sweeping direction) of the recording medium, which moves relative to the inkjet head in a direction (auxiliary sweeping direction) perpendicular to the moving direction of the inkjet head to form a two-dimensional image on the recording medium. Such an inkjet head is referred to as a serial type inkjet head.

In such an inkjet printer, since the inkjet head moves, an image forming speed is limited to a certain level, and is difficult to meet a recent demand of high-speed imaging. To meet such a demand, usage of a linear inkjet head attracts attention. The linear inkjet head is provided with a plurality of ink ejecting nozzles arranged in a line, which extends in a width direction (i.e., the main sweeping direction) of the recording medium. Typically, the linear inkjet head is fixed at a position, while the recording medium is driven to move at a high speed in the auxiliary sweeping direction, so that the imaging speed is greatly accelerated.

Incidentally, ink resides at the ink ejecting nozzles of the inkjet head tend to dry easily since it is exposed to the air. Therefore, before a printing job, and may also be during the printing job, a flushing operation for forcibly removing the residual ink at the ink ejecting nozzles may be performed. When the inkjet head is a serial type, a flushing position is defined, which is a position outside an imaging area for the recording sheet, and the flushing operation is performed with the inkjet head located at the flushing position.

However, when the inkjet head is a linear head, it is difficult to perform the flushing operation by moving the inkjet head to a position outside the imaging area of the recording medium since a wide space for allowing the inkjet head to move and a highly accurate driving mechanism to move the inkjet head between the operable position and a flushing position should be provided. A method in which a member that collects the forcibly discharged ink is moved to the inkjet head at every flushing operation has once been suggested. However, such a method requires a space and a mechanism for moving the ink collecting member. Further, it takes time to execute such a flushing operation, and is not suitable for the purpose of improving the imaging speed.

Japanese Patent Provisional Application No. 2001-71521 shows an exemplary configuration to cope with such a problem. In this publication, a rotatable cylindrical member having a slot, which is through-bored along the diameter and is elongated in the axial direction of the cylindrical member, is provided immediately below an inkjet head. Further, an ink absorbing member is provided so as to face the inkjet head with the rotatable cylindrical member therebetween. When the flushing operation is performed, the rotatable cylindrical member is rotated so that the inkjet head and the ink absorbing member face each other through the slot, and the ink discharged by the inkjet head is absorbed by the ink absorbing member.

Another configuration disclosed in Japanese Patent Provisional No. HEI 63-60850 includes an ink absorbing member which faces the nozzles, and a retractable platen is provided between the inkjet head and the ink absorbing member. In this configuration, when the flushing is performed, the platen is retracted from the position between the nozzles and the ink absorbing member so that the ejected ink is absorbed by the ink absorbing member.

Even in the configurations disclosed in the above publications, operations dedicated only to the flushing operation are required, and it may take several seconds to perform the flushing operation. If, for example, an imaging speed of an inkjet printer is 180 sheets/minute, and a flushing operation is performed at every completion of imaging on a sheet, the imaging speed is decelerated to 20 sheets/minute due to the flushing operations. Thus, image formation speed is fast but the effective imaging speed including the flushing operation cannot be sufficiently accelerated.

As such, an improved inkjet recording apparatus which can execute the flushing operation without decelerating the recording speed has been desired.

SUMMARY OF THE INVENTION

The present invention is advantageous in that an inkjet recording apparatus employing a linear inkjet head and is capable of performing a flushing operation without decelerating an imaging operation can be provided.

According to an aspect of the invention, there is provided an inkjet recording apparatus, which is provided with at least one inkjet head having nozzles which eject ink to recording medium, at least one platen arranged close to the at least one inkjet head so as to face the at least one inkjet head, the at least one platen having a rotatable cylindrical body. Further, a porous layer is provided at least a surface of the cylindrical body. The ink ejected from the nozzles to the cylindrical body is absorbed by the porous layer.

Optionally, a moving mechanism may be provided, which moves at least one of the inkjet head and the platen between a contact position where nozzles of the inkjet head and the platen contact and a non-contact position where the inkjet head and the platen are spaced from each other. At least one of the inkjet head and the platen is moved by the moving mechanism to the contact position when the nozzles are cleaned.

In a particular case, the porous layer has elasticity.

Further optionally, the inkjet recoding apparatus may include a pressing member that presses the platen. The ink permeated in the porous layer drains as the pressing member presses the platen.

Furthermore, a suction mechanism that sucks the ink permeated in the porous layer may be provided.

According to another aspect of the invention, there is provided an inkjet recording apparatus, which includes at least one inkjet head having nozzles which eject ink to recording medium, at least one platen arranged close to the at least one inkjet head so as to face the at least one inkjet head, the at least one platen having a rotatable cylindrical body, a circumferential surface of the cylindrical body being formed to repel the ink, and a cleaning structure that removes the ink ejected from the nozzles and applied to the circumferential surface of the cylindrical body.

Optionally, the cleaning structure may include a porous member which contacts the circumferential surface of the cylindrical body to absorb the ink thereon.

Further optionally, the platen may be formed of electrically insulative material, and a charging mechanism is provided to charge the platen so that the recording medium is attracted by the platen by electrostatic force.

Still optionally, the inkjet recording apparatus may include an ink absorbing member, which is elongated in a axial direction of the cylindrical body and is provided on the circumferential surface of the cylindrical body. Further, when the nozzles are cleaned, the ink absorbing member is brought into contact with the nozzles.

Further optionally, the at least one inkjet head includes a plurality of inkjet heads, and the at least one platen includes the plurality of platens respectively corresponding to the plurality of inkjet heads.

In a certain case, the plurality of inkjet heads ejects the inks having different colors, respectively.

The inkjet recording apparatus may include a blade member that extends in the axial direction of the cylindrical body and contacts the circumferential surface of the cylindrical body to scrape the ink applied thereon.

Further optionally, there is provided a porous member that extends in the axial direction of the cylindrical body and contacts the circumferential surface of the cylindrical body to absorb the ink applied thereon.

BRIEF DESCRIPTION OF THE ACCOMPANYING DRAWINGS

FIG. 1 schematically shows a structure of an inkjet recording apparatus according to an embodiment of the invention;

DESCRIPTION OF THE EMBODIMENTS

Hereinafter, embodiments according to the invention will be described with reference to the accompanying drawings.

Figure 1:
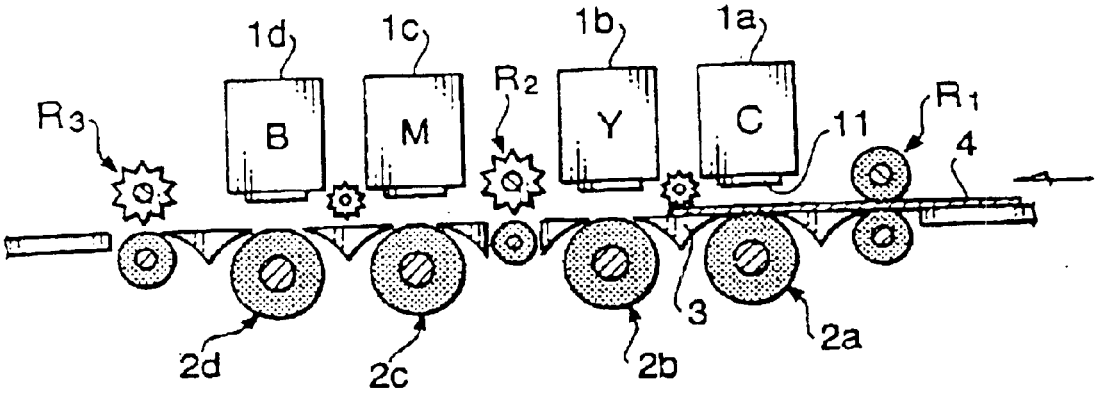

FIG. 1 shows a cross-sectional view of a part of an inkjet recording apparatus according to a first embodiment of the invention.

The inkjet recording apparatus is provided with linear inkjet heads 1*a*, 1*b*, 1*c* and 1*d* for ejecting cyan, yellow, magenta and black inks, respectively. It should be noted that structures of the inkjet head 1*a*–1*d* are the same, they will occasionally be represented by one inkjet head and referred to as the inkjet head 1 in the following description. The inkjet heads 1*a*–1*d* are arranged in a direction where recording medium 4 is fed.

Each of the inkjet heads 1*a*–1*d* has ink ejecting nozzles 11, and cylindrical platen member 2*a*, 2*b*, 2*c* and 2*d* are arranged to face the inkjet heads 1*a*–1*d*, respectively, as shown in FIG. 1. It should be noted that structures of the platen members 2*a*–2*d* are the same, they will occasionally be represented by one platen member and referred to as the platen member 2 in the following description.

The recording medium 4 (e.g., a sheet of paper) is fed, by a pair of feeding rollers R1, between the inkjet head 1 and the platen member 2, supported by intermediate rollers R2, from a right-hand side to a left-hard side in FIG. 1. Finally, the recording medium 4 is fed by a pair of discharging rollers R3 and discharged to outside. When the recording medium 4 travels between the inkjet heads 1*a*–1*d* and the platen members 2*a*–2*d*, each inkjet head 1 ejects ink, thereby a color image is formed on the recording medium 4.

First Embodiment

Figure 2:
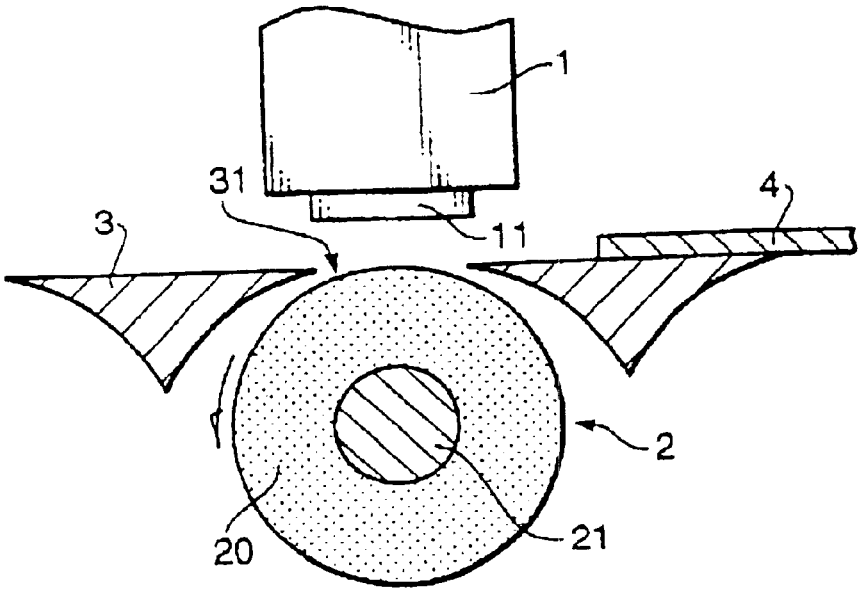
FIG. 2 shows a cross-sectional view of a part of the inkjet recording apparatus according to a first embodiment.

FIG. 2 shows a pair of the inkjet head 1 and the platen member 2. The inkjet recording apparatus has a recording medium supporting plate 3. On the supporting plate 3, a slot 31 is formed facing the nozzles 11 of the inkjet head 1. Below the slot 31, the platen member 2 is rotatably supported by a shaft 21 such that the uppermost end of the platen member 2 is located substantially at the same level of an upper surface of the supporting plate 3. According to a first embodiment, the platen member 2 has a cylindrical body having a porous layer at least a surface thereof. The porous layer is capable of absorbing ink dropped thereon.

Between the nozzles 11 and the platen member 2, a clearance which is greater than a thickness of the recording medium 4 is formed, and the recording is fed through the clearance.

When an image is recorded on the recording medium 4 with the image recoding apparatus described above, the recording medium 4 is fed between the nozzles 11 and the platen member 2. The ink is ejected from the nozzles 11 when the recording medium 4 is supported on the platen member 2.

When a flushing operation is performed to forcibly eject the ink which is about to dry out from the nozzles 11, the inkjet head 1 is driven to eject a small amount of ink toward the platen member 2 through the nozzles 11 when the recording medium 4 is not located between the inkjet head 1 and the platen member 2 since the surface of the platen member 2 is provided with the porous layer 20, the ink ejected from the nozzles 11 does not stay on the surface of the platen member 2, but permeates immediately. Thereafter, the platen member 2 is rotated so that another portion of the surface of the porous layer 20 is located at the slot 31. Therefore, a back surface (i.e., the platen member side surface) of a newly fed recording medium 4 may not be tainted with ink ejected, at the flushing operation, from the nozzles 11.

As material for the platen member, any material may be applicable as far as a porous layer is provided on the surface facing the inkjet head 1. In a certain case, it is preferable that the porous layer, or an entire platen member has elasticity. An example of the material is a ceramic porous body. Other examples, which function as an elastic member, are expandable polystyrene, expandable polyethylene, sponge-form synthesized fabric and the like. In view of quick absorption of the ejected ink, foams of the porous body may have a continuous cellar structure. In this regard, it is preferable to use viscose sponge, soft urethane foam body and the like.

Second Embodiment

Figure 3A:
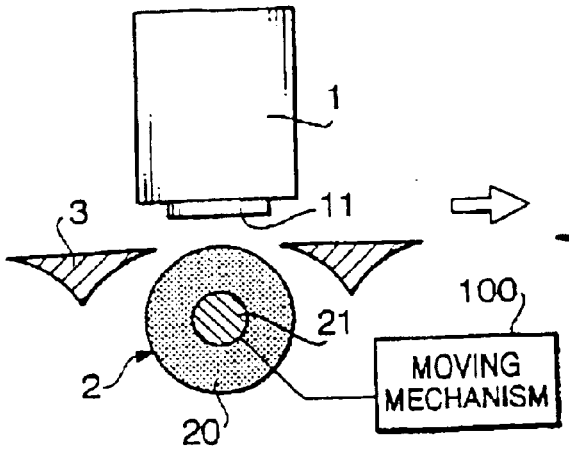
FIGS. 3A and 3B show cross sectional view of a part of inkjet recording apparatus according to a second embodiment.

Paper powder and/or dust tend to adhere to the nozzles 11 of the inkjet head 1. Due to the adhered power powder and/or dust, the nozzles 11 may be clogged. To cope with this problem, a moving mechanism 100 which is capable of moving the platen 2 vertically (i.e. toward and away from the nozzles 11) is provided in the second embodiment shown in FIGS. 3A and 3B.

Figure 3B:
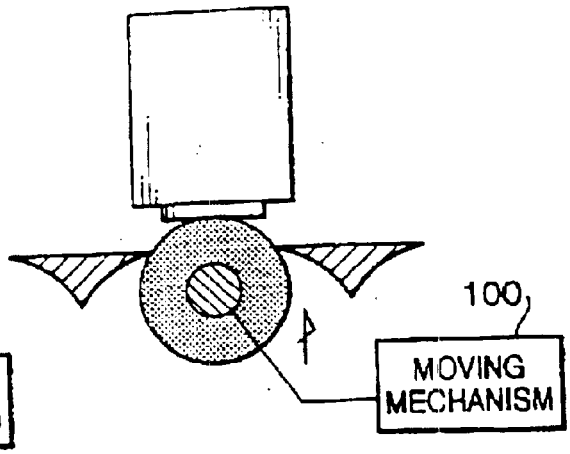

The structure of the inkjet head according to the second embodiment is similar to that of the first of the invention except that the moving mechanism 100 is provided and the platen 2 is configured to be movable by the moving mechanism 100. When the ink is ejected from the nozzles 11, the platen 2 is located at a position similar to that of the first embodiment. When the nozzles 11 is to be cleaned, the moving mechanism 100 is driven to lift the platen so that the platen 2 contacts the nozzles 11 as shown in FIG. 3B. At this stage, the platen 2 may be rotated or swung. Since the surface of the platen 2 has an ink absorbing property, even if the platen 2 is not rotated or swung, the ink resides at the nozzles can be absorbed. In particular, if the nozzles 11 have a structure which is relatively fragile, it is preferable that the platen 2 is not rotated when contacted with the nozzles 11. Further, the platen 2 may be slightly urged against the nozzles 11.

As the moving mechanism 100, various mechanism conventionally known can be employed. As to a timing when the nozzles are cleaned, there is no limitation. For example, the cleaning is carried out periodically. Alternatively or optionally, the cleaning may be carried out when the recording apparatus has not been used for a certain period, when the recording apparatus is powered on and/or when a user of the recording apparatus desires to do the cleaning.

Alternatively or optionally, the moving mechanism 100 may move the inkjet head 1. That is, at least one of the inkjet head and the platen 2 is moved, the cleaning operation can be done.

Third Embodiment

Figure 4:
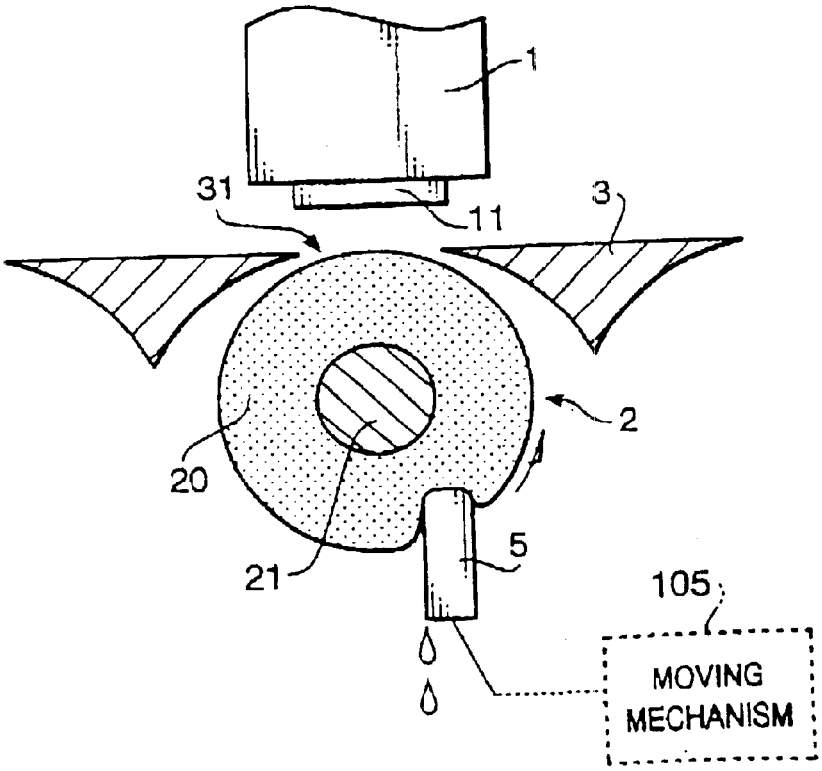
FIG. 4 shows a cross-sectional view of a part of the inkjet recording apparatus provided with an ink exploiting member according to a third embodiment.

In the first and second embodiments, when the porous layer absorbs the ejected ink to its full capacity, the porous layer or the entire platen 2 may be exchanged with a new one. However, in view of a maintenance management, it may be advantageous that the absorbed ink is removed from the porous layer. FIG. 4 shows an example of such a configuration according to a third embodiment.

The structure shown in FIG. 4 is similar to that shown in FIG. 2 except that a pressing member 5 is provided, and the porous layer 20 has elasticity. By pressing the elastic porous layer 20 so that the ink permeated in the elastic porous layer 20 is expressed. As the pressing member 5, a plate like member having a width substantially the same as the width of the platen 2 or more. The pressing member 5 may continuously press the elastic porous layer 20. Alternatively, a moving mechanism 105 may be provided (as indicated by broken lines) so that the pressing member 5 is normally retracted from the pressing position shown in FIG. 4, and is press-contacted to the elastic porous layer 20 when necessary. In view of the load to the platen 2 when it is rotated, the latter configuration is preferable. The degree of an insertion length of the pressing member with respect to the surface of the porous layer 20 may be determined in accordance with the size and material of the elastic porous layer 20.

Fourth Embodiment

Figure 5:
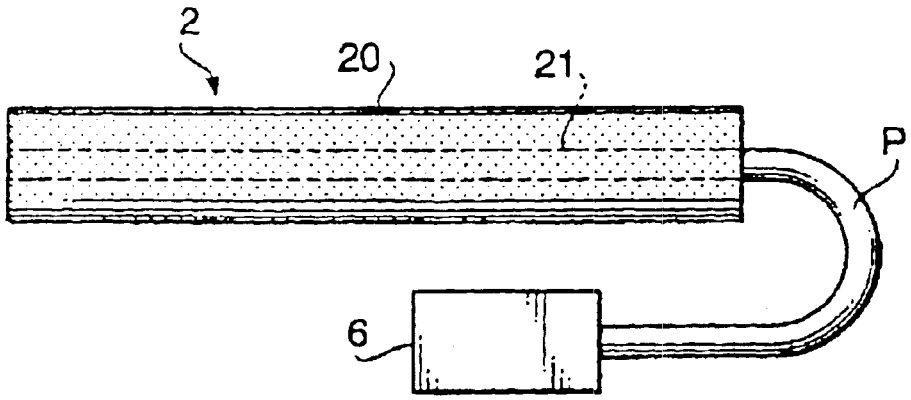
FIG. 5 shows a front view of a platen provided with an ink suction mechanism according to a fourth embodiment.

FIG. 5 shows another configuration for removing the ink from the elastic porous layer 20. FIG. 5 shows a front view of the platen 2. According to the fifth embodiment, the elastic porous layer 20 surrounds a shaft 21, and one end of the shaft 21 is connected with a suction pump 6 with a tube P. Although not clearly indicated in FIG. 5, the shaft 21 is a hollow cylinder, and a plurality of minute through holes are formed on a cylindrical wall. With this configuration, when the suction pump 6 is actuated, the ink ejected by the inkjet head 1 and applied onto the elastic porous layer 20 of the platen 2 is sucked inside the porous layer 20. Further, the ink is sucked through the minute through holes inside the hollow shaft 21, and into the suction pump through the tube P. It should be noted that, with this configuration, the suction effect of the suction pump 6 for forcibly moving the ink from the surface of the elastic porous layer 20 to inside and further inside the hollow shaft 21 operates in addition to the absorbing effect due to the porous structure of the elastic porous layer 20. Thus, it is ensured that the ink applied on the surface of the porous layer 20 can be removed from the outer surface. It should be noted that the suction pump 6 may operate continuously, periodically or only when necessary.

In the above embodiments, the platen 2 is configured such that the elastic porous layer 20 is formed around the shaft 21. However, the invention is not limited to such a configuration. For example, instead of the elastic porous layer, non-elastic porous layer such as a ceramic porous layer may be employed. Further, when the platen employs a rigid porous layer such as the ceramic porous layer the shaft 21 need not be provided to extend across the width of the platen 2. For example, if the porous layer 20 has a sufficient elasticity such as one formed of the ceramic porous layer, the shaft 21 may be provided only at each side end of the porous layer 20. Alternatively, a through hole along the central axis of the cylindrical ceramic porous layer 20 is formed, and the shaft 21 is provided only at each end of the cylindrical ceramic porous layer. In such a case, a through opening extending in the axial direction may be formed on the shaft 21 or a hollow needle is provided to penetrate the shaft 21 so that the through hole is set to have a negative pressure with use of the suction pump 6.

Fifth Embodiment

Figure 6:
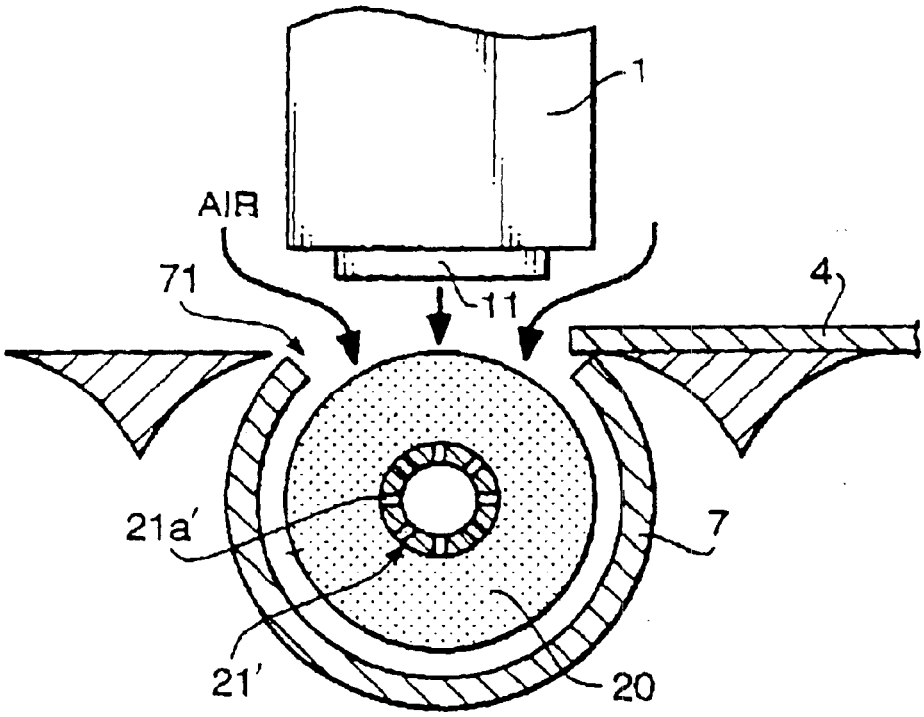
FIG. 6 shows a cross-sectional view of a part of the inkjet recording apparatus provided with an ink suction mechanism according to a fifth embodiment.

It would be advantageous if the suction mechanism as described above is used for attracting the recording medium 4 so that the recording medium 4 is prevented from lifting when it is fed. FIG. 6 shows a fifth embodiment illustrating such a configuration. The structure of the platen 2 is similar to that of the fourth embodiment shown in FIG. 4. That is, the shaft 21 is a hollow cylinder and minute through holes are formed on the cylindrical wall of the shaft 21. Further, similarly to the fourth embodiment, the suction pump 6 is connected to one end of the shaft 21 via the tube P.

Further to the above, in the fifth embodiment shown in FIG. 6, the platen 2 is surrounded by a cylindrical cover member 7 which is formed with a slit 71 on the upper side so that the platen 2 face the nozzles 11 through the slit 71.

With this configuration, when the suction pump 6 operates, the air is sucked by the suction pump 6, and then the air flows into the platen 2 through the slit 71, thereby the recording medium 4 as fed and reached the slit 71 is attracted from the platen 2 and the lifting of the recording medium 4 is effectively prevented.

Further, the structure shown in FIG. 6 may be modified such that the cover member 7 may be formed to contact the platen 2 with remaining the slit 71 as it is. In such a modification, the air flow which prevents the lifting of the recording medium 4 on the platen 2 is limited to a portion of the platen exposed through the slit 71. In such a structure, the suction force for sucking the ink applied onto the platen 2 inside thereof, and the force for preventing the recording medium 4 from lifting can be applied efficiently and effectively.

It should be noted that, in the above description, the porous layer 20 is the elastic member. However, the invention is not limited to such a configuration, and the porous layer can be made of ceramic porous member.

Sixth Embodiment

Next, an inkjet recording apparatus according to a sixth embodiment will be described. It should be noted that, in the sixth embodiment and the following embodiments, the platen 2M does not absorb the ink, and a cleaning member for removing the ink applied on the circumferential surface of the platen 2M is provided.

Figure 7:
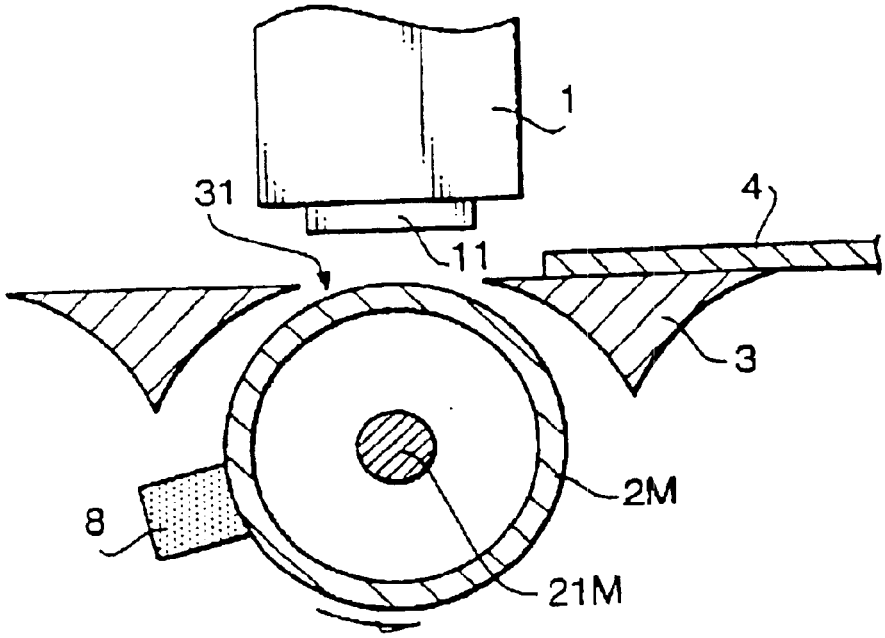
FIG. 7 shows a cross-sectional view of a part of the inkjet recording apparatus according to a sixth embodiment.

FIG. 7 shows a cross-sectional view of the inkjet head 1 and a platen 2M according to the sixth embodiment. Similarly to the first embodiment shown in FIG. 2, the slot 31 is formed on the supporting plate 3 so as to face the nozzles 11. Below the slot 31, the platen 2M is provided. The platen 2M is rotatably supported by a shaft 21M, and the uppermost portion of the platen 2M is substantially at the same level of the upper surface of the supporting plate 3.

As described above, the platen 2M is a cylindrical body which does not absorb the ink. Further, a cleaning member 8 is provided such that it contacts the circumferential surface of the platen 2M. As the platen 2M rotates, the ink applied onto the circumferential surface of the platen 2M is located at the cleaning member 8 and is removed thereby.

There is no limitation as to the material of the platen 2M as far as it does not absorb the ink. For example, plastic material such as polyimide, polyacetal, fluorocarbon resin, polysulfone, polyphenylene sulfide, metallic material such as stainless steel, aluminum and copper, rubber material such as diene rubber, olefin rubber, urethane rubber, silicon rubber and fluorine rubber. In particular, it is preferable that the platen 2M has a water-shedding property. It should be noted that even thought the material does not have a sufficient water-shedding property, by applying a water-shedding coating onto the circumferential surface of the platen 2M, a sufficient function can be obtained.

As the cleaning member B, for example, elastic porous member which removes the ink on the circumferential surface of the platen 2M by absorbing, or a rubber blade which scrapes the ink on the circumferential surface of the platen 2M away. In FIG. 7, the cleaning member 8 is the elastic porous member. The cleaning member 8 may be continuously contact the circumferential surface of the platen 2M. Alternatively, it may be brought into contact the platen 2M when the flushing operation is carried out. If the flushing is performed relatively frequently, it is preferable and efficient that the cleaning member 8 continuously contacts the platen 2M.

Seventh Embodiment

Figure 8:
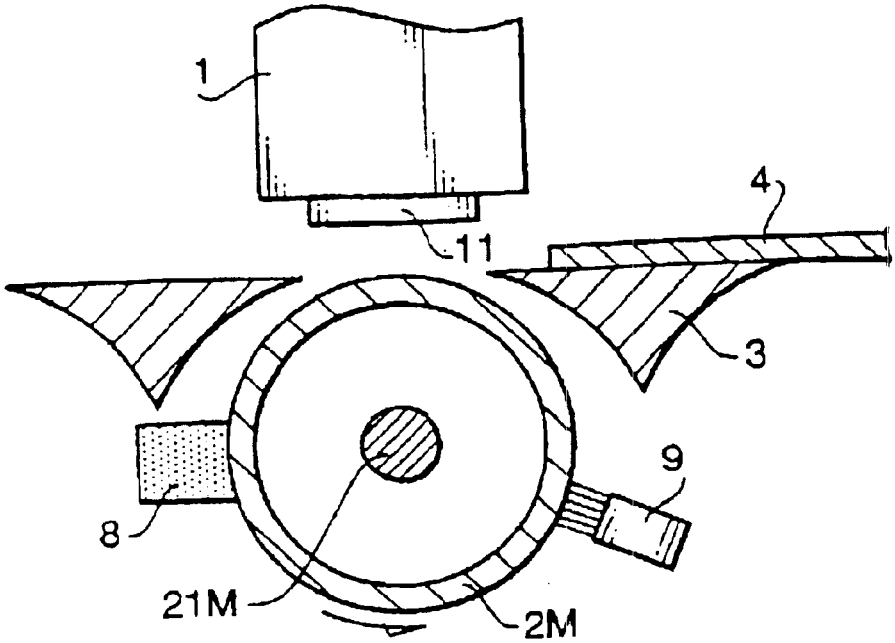
FIG. 8 is a cross-sectional view of a part of the inkjet recording apparatus provided with a electro-static chargeable member according to a seventh embodiment.

FIG. 8 shows a cross-sectional view of the platen 2M and the inkjet head 1 according to the seventh embodiment. The seventh embodiment is similar to the sixth embodiment except that the platen 2M is configured to have an electrically insulative, and a charging member 9 is provided to contact the circumferential surface of the platen 2M. By electrostatically charging the platen 2M, the recording medium 4 is attracted, thereby lifting of the recording medium 4 being prevented. As the charging member 9, a corona charger which applies ions generated by corona discharge, or blush charger or roller charger which directly contacts the platen 2M and provides electronic charges or ions thereto can be employed. In an example shown in FIG. 8, the blush charger is employed.

Eighth Embodiment

Figure 9A:
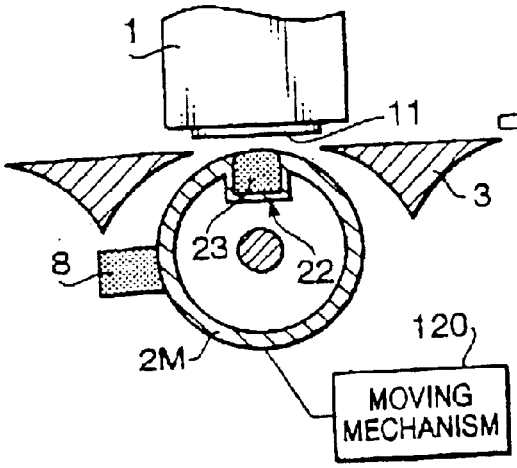
FIGS. 9A and 9B show cross-sectional views of a part of inkjet recording apparatus provided with a cleaning member according to an eighth embodiment.
Figure 9B:
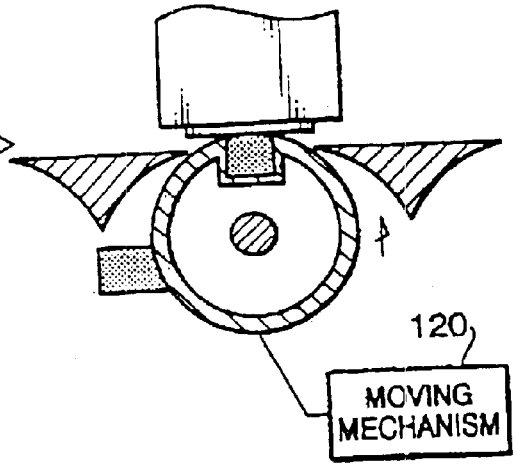

FIGS. 9A and 9B show a configuration of the platen according to an eighth embodiment.

As shown in FIGS. 1A and 9B, according to the eighth embodiment, a wiper 23 for wiping the ink adhered on the nozzles 11 of the inkjet head 1 is provided at the outer circumferential of the platen 2M. It should be noted that, also in this embodiment, the cleaning member 8 is provided to contact the circumferential surface of the platen 2M.

Specifically, according to the eighth embodiment, a groove 22 extending in the axial direction of the platen 2M is formed on the surface thereof, and the wiper 23 is fitted in the groove 22 such that the upper surface of the wiper 23 is substantially the same level as the circumferential surface of the platen 2M.

In a normal state, there is a clearance between the circumferential surface of the platen 2M and the nozzles 11. Thus, even if the platen 2M is rotated, the circumferential surface of the platen 2M, and therefore the wiper 23, do not contact the nozzles 11. When a wiping operation is to be carried out, as show in FIG. 9B, the platen 2M is lifted toward the inkjet head with use of a moving mechanism 120 so that the wiper 23 contacts the nozzles 11. At this stage, the platen 2M may be swung reciprocally in the recording medium feeding direction and opposite directions. Alternatively, only by press-contacting the wiper 23, the ink adhered on the nozzles 11 can be removed.

As the wiper 23, elastic porous member such as sponge or polyurethane rubber may be used.

Figure 10A:
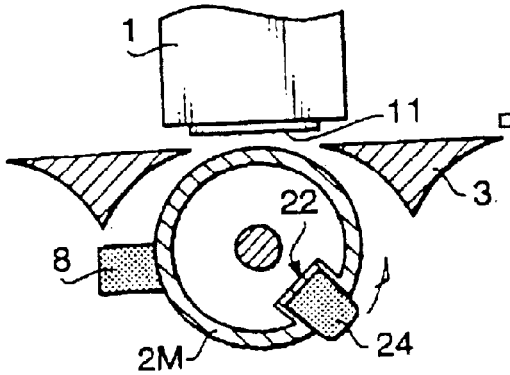
FIGS. 10A and 10B show cross-sectional views of a part of the inkjet recording apparatus provided with another cleaning member according to a ninth embodiment.
Figure 10B:
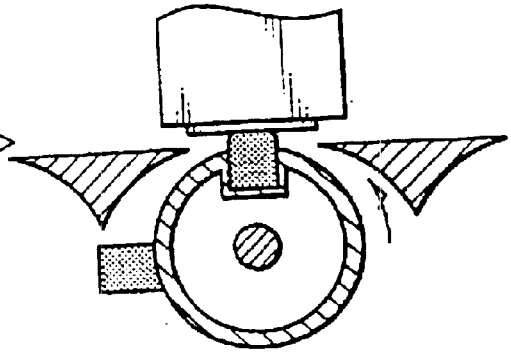

FIGS. 10A and 10B show alternative configuration according to a ninth embodiment of the invention.

In the ninth embodiment, a wiper 24 which is protruded from the circumferential surface of the platen 2M is provided. The protruded amount of the wiper 24 is slightly greater than the clearance between the circumferential surface of the platen 2M and the nozzles 11. Therefore, when the platen 2M is rotated so that the wiper 24 passes the nozzles 11, the wiper 24 rubs the nozzles 11, thereby the wiping of the ink from the nozzles 11 is carried out. With this configuration, the moving mechanism 120 employed in the eighth embodiment can be omitted. It should be noted, however, if the protruded amount of the wiper 24 is too large, the nozzles 11 may be rubbed excessively and the tend to be damaged thereby, and further, the rotational load of the platen 2M becomes too large. Therefore, it is preferable that the protruding amount of the wiper with respect to the circumferential surface of the platen 2M is substantially the same as the clearance between the circumferential surface of the platen 2M and the nozzles 11.

Also in this embodiment, the cleaning member 8 may be provided to contact the platen 2M as shown in FIGS. 10A and 10B. It should be noted that, in the ninth embodiment, since the wiper 24 is protruded from the circumferential surface of the platen 2M, if the platen 2M is rotated with the cleaning member 8 being contacted with the circumferential surface of the platen 2M, one or both of the wiper 24 and the cleaning member 8 may be damaged. In order to avoid such a problem, the cleaning member 8 may be configured to be retractable or rotation of the platen 2M is controlled such that the wiper 24 does not pass the portion where the cleaning member 8 is provided and rotate reversely.

Tenth Embodiment

Figure 11A:
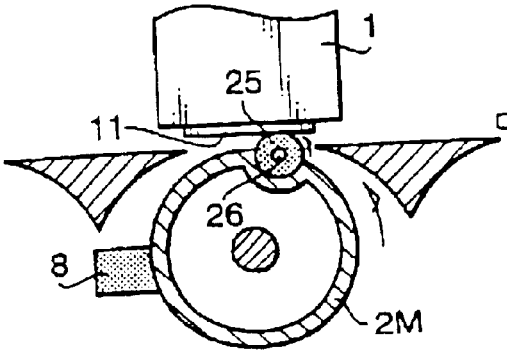
FIGS. 11A and 11B show cross-sectional views of a part of an inkjet recording apparatus provided with another cleaning member according to a tenth embodiment.
Figure 11B:
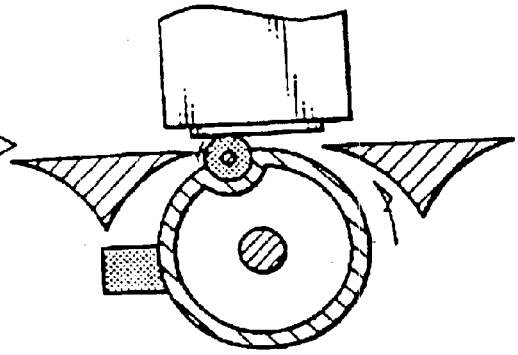

FIGS. 11A and 11B show a further alternative configuration where a wiper is provided on the platen 2M. According to the tenth embodiment, in order to avoid the nozzles 11 from being rubbed by the wiper with excessive friction, a roller type wiper 25, which is self-rotatable, is provided. The protruded amount of the wiper 25 with respect to the circumferential surface of the platen 2M is substantially the same as the clearance between the circumferential surface of the platen 2M and the nozzles 11. With this configuration, similarly to the ninth embodiment, the wiper 25 contacts the nozzles 11 as the platen 2M rotates, thereby the wiping of the ink adhered to the nozzles 11 is carried out.

In the tenth embodiment, however, the wiper 25 self-rotates about its rotation shaft 26 as it contacts the nozzles 11. Therefore, the frictional force applied to the nozzles 11 is very small, and the nozzles 11 may not be damaged.

The wiper 25 may be arranged to contact a concave groove formed on the outer circumferential of the platen 2M. In such a case, the ink absorbed by the wiper 25 may be sucked from a bottom surface of the concave groove with use of a suction pump 6 (not shown in FIGS. 11A and 11B). Such a modification can be made in the eighth and ninth embodiments. That is, the ink absorbed by the wiper 23 or 24 may be sucked from a bottom surface of the groove 22 with use of the suction pump 6. With such a modification, the wiper 23, 24 or 25 can be kept clean for a long period, and the wiping effect of the wiper 23, 24 and 25 can be maintained for a long period.

In the eighth, ninth or tenth embodiment, as the platen 2M rotates, the wiper 23, 24 or 25 also rotates and contacts the cleaning member 8. In such a case, the ink may transferred from the wiper to the cleaning member 8. Further, if the wiper is protruded from the circumferential surface of the platen 2M, the wiper and the cleaning member 8 may be deteriorated easily. AS a result, the life cycle of both the wiper and the cleaning member 8 is shortened, and frequency of exchanging the members may be increased. In order to avoid such a problem, it is preferable to make the cleaning member 8 retractable. That is, it is preferable that the cleaning member 8 is temporarily retracted to a position at which the cleaning member 8 does not contact the wiper when the platen 2M rotates and the wiper becomes close to the cleaning member 8. Alternatively, the rotation of the platen 2M is reversed when the wiper become close to the cleaning member 8 so that the wiper does not contact the cleaning member 8.

FIGS. 12A through 12G show control of the platens 2A through 2D (which will be occasionally referred to as platen 2M). In this example, four platens 2A through 2D are arranged in a direction where the recording medium is fed. The platens 2A through 2D rotates synchronously such that the rotational positions of the wipers 23 are identical.

Figure 12A:
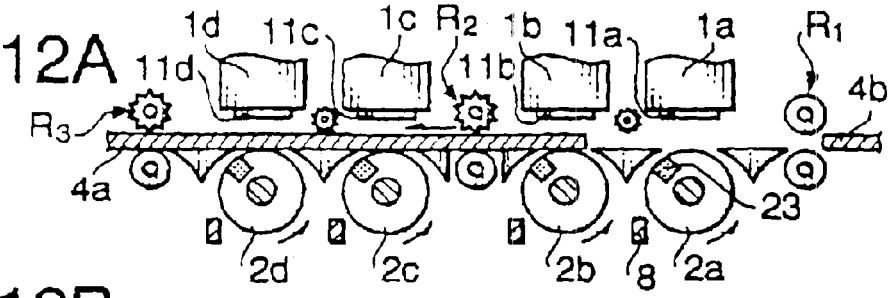
FIGS. 12A through 12G show cross-sectional side views of a part of the inkjet recording apparatus illustrating control of rotating platen members.

FIG. 12A shows a condition where the trailing end of first recording medium 4*a* has passed a first inkjet head 1*a*, and the leading end of second recording medium 4*b* has not reached the first inkjet head 1*a*. At this stage, the wiper 23 of the platen 2*a* is located at an upper-left position of the first platen 2*a*. With this condition, the flushing of the first nozzles 11*a* is carried out and the ink is ejected onto the surface of the first platen 2*a*. At this stage, the cleaning members 8 are located at retracted positions, as shown in FIG. 12A, so as not to interfere with the wipers 23.

Figure 12B:
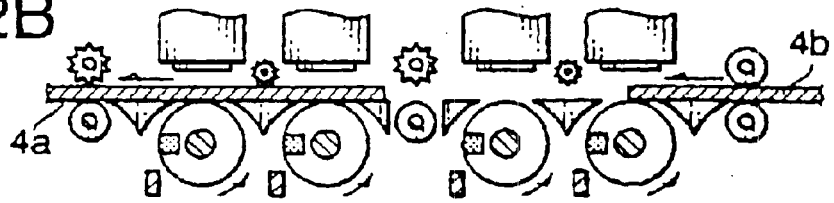
Figure 12C:
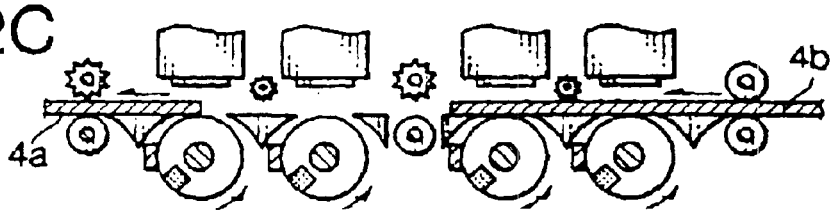

As the trailing end of the first recording medium 4*a* has passed, the flushing of the second inkjet head 1*b*, the third inkjet head 1*c* is performed sequentially, as shown in FIGS. 12B and 12C. During the above operations, the platens 2 are rotated at a constant speed. When the flushing operation of the third inkjet head 1*c* is performed, the wipers 23 have passed the cleaning positions (left-hand side of each platen) and located at lower-left positions, and thus, the cleaning members 8 are moved from the retracted positions to operable positions (see FIG. 12C) where the cleaning members 8 contact the platens 2, respectively.

Figure 12D:
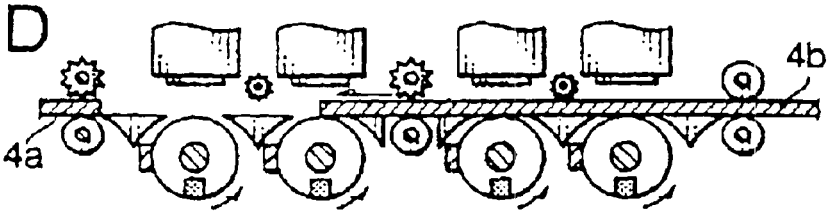
Figure 12E:
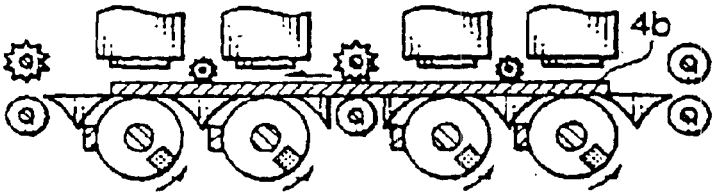
Figure 12F:
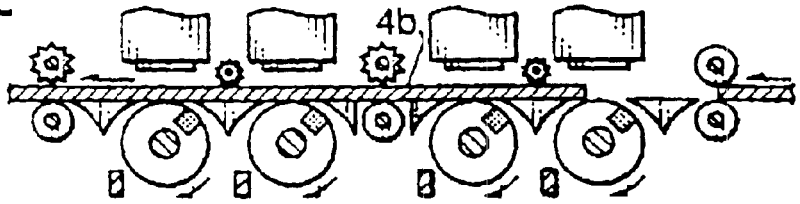
Figure 12G:
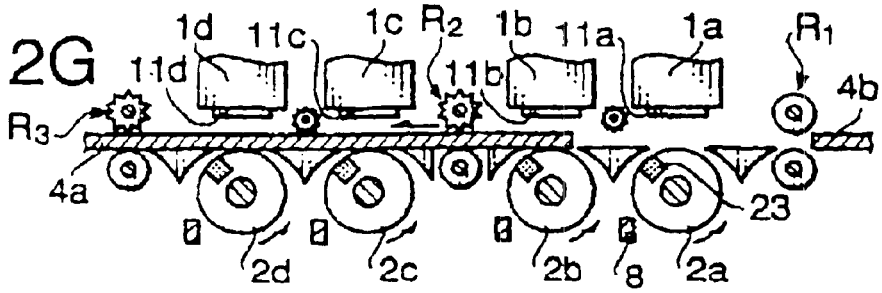

Then, the trailing end of the first recording medium 4*a* has passed the fourth inkjet head 1*d*, and the flushing thereof is carried out (see FIG. 12D). When the first recording medium 4*a* is discharged, the second recording medium 4*b* has been fed and recording operation has been started as shown in FIG. 12E. When the trailing end of the second recording medium 4*b* has passed the first inkjet head 1*a* (see FIG. 12F), the flushing of the first inkjet head 1*a* is performed again. If the platens 2 keep rotating in the same direction, however, the ink ejected by the first inkjet head 1*a* may be applied onto the wiper 23 of the first platen 2A. To avoid this problem it is necessary to move the wipers 23 from the upper-right positions to the upper-left positions, respectively. However, if the platens 2 are rotated quickly in the same direction (i.e., counterclockwise in FIG. 12F), since the second recording medium 4*b* is located on the second through fourth platens 12B through 12D, the wipers 23 of the second through fourth platens 12B through 12D contact the back surface of the recording medium 4*b* and may apply the ink on the back surface of the second recording medium 4*b*.

In this example, therefore, the platens 2 are reversely rotated (clockwise) such that the wipers 23 are moved from the upper-right positions to the upper-left positions (see FIGS. 12F and 12G) so that the ejected ink is not applied onto the wipers 23 directly, thereby deterioration of the back surface of the recording medium 4*b* is avoidable. It should be noted that, since the platens 2 are rotated clockwise, the cleaning members 8 should be moved to the retracted positions, respectively.

Eleventh Embodiment

Figure 13:
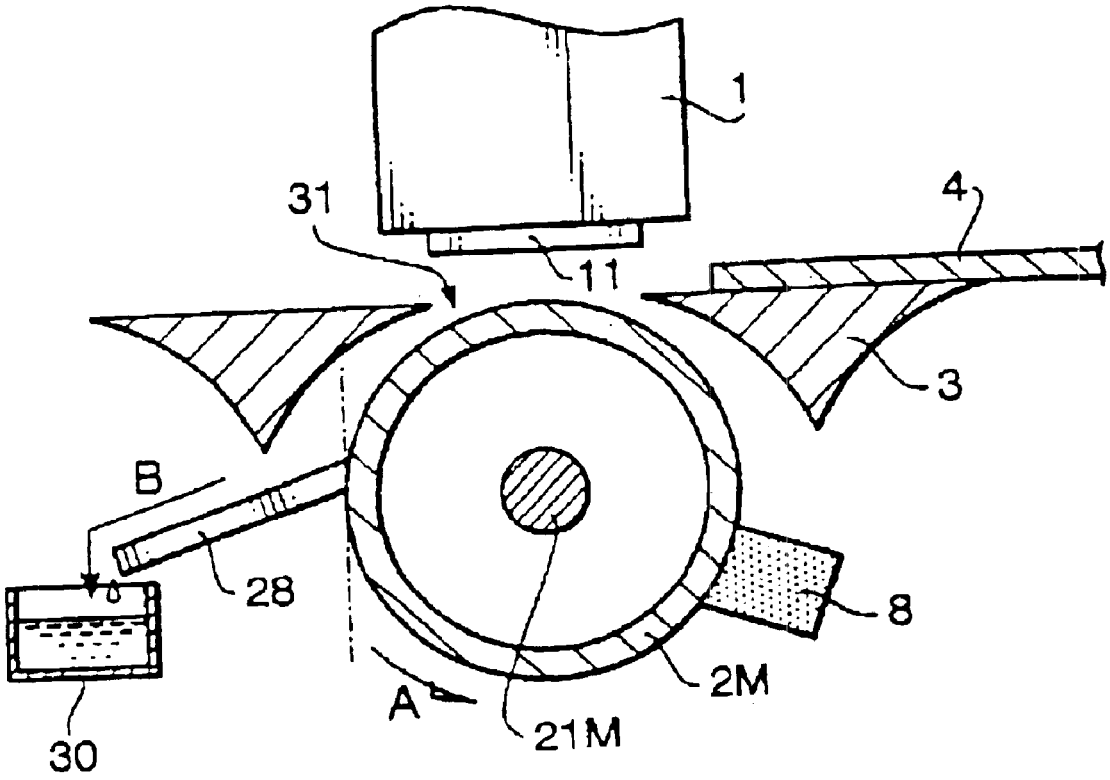
FIG. 13 is a cross-sectional view of a part of the inkjet recording apparatus according to an eleventh embodiment.

Hereinafter, an eleventh embodiment will be described. The inkjet recording apparatus according to the eleventh embodiment is configured such that the platen does not absorb the ink, and an ink removing structure is provided to remove the ink applied on the circumferential surface of the platen, similarly to the sixth through tenth embodiments. According to the eleventh embodiment, the ink removing structure includes a porous member which contacts the circumferential surface of the platen and absorbs the ink thereon, and a scarping member which scrapes the circumferential surface of the platen. FIG. 13 shows a structure of the inkjet head 1, platen 2M and the ink removing structure according to the eleventh embodiment.

Similarly to the sixth embodiment, the slot 31 is formed on the supporting plate 3, and below the slot 31, the platen 2M is arranged to face the nozzles 11 through the slot 31. The platen 2M is rotatably supported by the shaft 21M. The uppermost portion of the platen 2M is substantially the same level as the upper surface of the supporting plate 3. The platen 2M is a cylindrical body which does not absorb the ink.

As shown in FIG. 13, as the ink removing structure, a blade 28 and the cleaning member (porous body) 8 are arranged so as to contact the circumferential surface of the platen 2M. According to the eleventh embodiment, the blade 28 and the cleaning member 8 are arranged such that the blade 28 is on an upstream side and the cleaning member 8 is on the downstream side along the rotational direction of the platen 2M indicated by arrow A. It should be noted that the blade 28 is oriented such that an angle formed between the blade 28 and a plane tangential to the circumferential surface of the platen 2M at a position where the blade 28 contacts the circumferential surface of the platen 2M on the downstream side is an acute angle. That is, the distal end of the blade 28 is lower than the other end.

The ink adhered on the circumferential surface of the platen 2M due to the flushing of the inkjet head 1 moves in the direction A as the platen 2M rotates, and firstly scraped by the blade 28. As shown in FIG. 13, the blade 28 is inclined so that the distal end is lower than the other end. Accordingly, the scraped ink flows, as indicated by arrow B, along the blade and temporarily pooled in a waste ink tank 30 arranged below the distal end of the blade 28.

It should be noted that, some ink applied on the circumferential surface of the platen 2M may not be scraped by the blade 28, and remains on the circumferential surface of the platen 2M. According to the configuration shown in FIG. 13, such ink is absorbed by the elastic cleaning member 8.

As the material of the platen 2M according to the eleventh embodiment, any material which does not absorb the ink can be used. For example, the material as employed in the sixth through tenth embodiments may be employed. Preferably, the platen 2M may have water-shielding property. Thus, the platen 2M may be formed of the water-shielding material, or a water-shielding coating is applied on the circumferential surface of the platen 2M. Regarding the water-shielding property, it is preferable that a contact angle of the ink with respect to the circumferential surface of the platen 2M is 20 degrees or more. With such a configuration, the ink applied onto the circumferential surface of the platen 2M due to the flushing operation may easily be removed, and accordingly, the ink can be removed easily with use of the ink removing structure.

It is preferable that the blade is made of urethane rubber, and the porous member may be foamed of polystyrene, foamed polyethylene, spongiform synthesized fiber and the like. In this case, the foamed structure may preferably have continuous cell structure, and thus, viscose sponge or soft foamed urethane may be used. Such material can absorb the ink quickly.

As described above, according to the eleventh embodiment, the platen includes a cylindrical member which does not absorb the ink, and a core member (i.e., a shaft) which rotatably supports the cylindrical member. The ink removing structure for removing the ink on the circumferential surface of the cylindrical member is provided. Specifically, the ink removing structure includes the blade scrapes the ink from the circumferential surface of the cylindrical member, and the porous member which also contacts the circumferential surface of the cylindrical member, and absorbs the residual ink which has not been scraped by the blade. Thus, although the ink is directly ejected from the nozzles to the platen, it is ensured that the ink applied on the platen can be well removed by scraping and absorbing. With this structure, it is possible to execute the flushing by making use of a space between the successively fed recording medium. Accordingly, the flushing operation and recording operation can be executed without decreasing the recording speed. Further, an additional mechanism for receiving the ink from the nozzles only for the flushing operation is unnecessary. Therefore, a structure/mechanism for moving such an additional mechanism is also unnecessary, and a room for such mechanism/movement is also unnecessary. Therefore, according to the eleventh embodiment, the inkjet recording apparatus can be made compact. Further, since the additional mechanism is unnecessary, the apparatus can be made at a relatively low manufacturing cost.

In the eleventh embodiment, the platen 2M may be formed to be electrically insulated, and a charging member may be provided as in the seventh embodiment, to charge the platen 2M so that the recording medium is attracted toward the platen with the electrostatic force to prevent the recording medium from lifting at the inkjet bead.

In the above description, the inkjet recording apparatus employing the linear inkjet head is explained. However, the invention is not limited to such a recording apparatus, and is applicable to the serial type inkjet head.

Further, the invention is not limited to the configuration of the above-described embodiments, and can be modified in various ways without departing from the scope of the invention.

It should be noted that, although various configurations are described as separate embodiments, the invention should not be limited to respective embodiments, and it may be possible to suitably combine features of two or more embodiments.

The present disclosure relates to the subject matter contained in Japanese Patent Application No. 2002-145580, filed on May 21, 2002, which is expressly incorporated herein by reference in its entirety.

What is claimed is:

1. An inkjet recording apparatus, comprising:

at least one inkjet head having nozzles, said nozzles ejecting ink to recording medium;

at least one platen arranged close to said at least one inkjet head so as to face said at least one inkjet head, said at least one platen having a rotatable cylindrical body; and a porous layer provided on at least a whole circumferential surface of said cylindrical body, said porous layer absorbing the ink ejected from said nozzles to said cylindrical body.

2. The inkjet recording apparatus according to claim 1, further comprising a moving mechanism that moves at least one of said inkjet head and said platen between a contact position where said nozzles and said platen contact and a non-contact position where said inkjet head and said platen are spaced from each other, at least one of said inkjet head and said platen being moved by said moving mechanism to the contact position when said nozzles are cleaned.

3. The inkjet recording apparatus according to claim 1, wherein said porous layer has elasticity.

4. The inkjet recoding apparatus according to claim 3, further comprising a pressing member that presses said platen, the ink permeated in said porous layer draining as said pressing member presses said platen.

5. The inkjet recording apparatus according to claim 4, further comprising a moving mechanism that moves said pressing member between a pressing position at which said pressing member presses said platen and a retracted position where said pressing member does not press said platen.

6. The inkjet recording apparatus according to claim 1, further comprising a suction mechanism that sucks the ink permeated in said porous layer.

7. The inkjet recording apparatus according to claim 6, wherein said platen includes a hollow shaft supporting said cylindrical body, said cylindrical body being formed of porous material, said hollow shaft being formed with a plurality of minute holes on its circumferential wall, said hollow shaft being connected with a suction pump, the ink permeated in said cylindrical body being sucked through said minute opening and said hollow shaft.

8. The inkjet recording apparatus according to claim 7, further provided with a cylindrical cover surrounding said cylindrical body with a predetermined clearance, said cylindrical cover being formed with a slot corresponding to a position facing said inkjet head.

9. The inkjet recording apparatus according to claim 1, wherein said at least one inkjet head includes a plurality of inkjet heads, and wherein said at least one platen includes the plurality of platens respectively corresponding to the plurality of inkjet heads.

10. The inkjet recording apparatus according to claim 9, wherein said plurality of inkjet heads ejects the inks having different colors, respectively.

11. An inkjet recording apparatus, comprising:

at least one inkjet head having nozzles, said nozzles ejecting ink to recording medium;

at least one platen arranged close to said at least one inkjet head so as to face said at least one inkjet head, said at least one platen having a rotatable cylindrical body, a circumferential surface of said cylindrical body being formed to repel the ink; and a cleaning structure that removes the ink ejected from said nozzles and applied to the circumferential surface of said cylindrical body.

12. The inkjet recording apparatus according to claim 11, wherein said cleaning structure including a porous member which contacts the circumferential surface of said cylindrical body to absorb the ink thereon.

13. The inkjet recording apparatus according to claim 11, wherein said platen is formed of electrically insulating material, and wherein a charging mechanism is provided to charge the platen so that the recording medium is attracted by said platen by electrostatic force.

14. The inkjet recording apparatus according to claim 11, further comprising an ink absorbing member, which is elongated in a axial direction of said cylindrical body, is provided on the circumferential surface of said cylindrical body, wherein when said nozzles are cleaned, said ink absorbing member is brought into contact with said nozzles.

15. The inkjet recording apparatus according to claim 14, further comprising a moving mechanism that moves at least one of said inkjet head and said platen between a contact position where said nozzles and said ink absorbing member contact and a non-contact position where said inkjet head and said platen are spaced from each other, at least one of said inkjet head and said platen being moved by said moving mechanism to the contact position when said nozzles are cleaned.

16. The inkjet recording apparatus according to claim 14, wherein said ink absorbing member is protruded with respect to the circumferential surface of said cylindrical body, a protruded amount of said ink absorbing member being substantially the same as a clearance between said inkjet head and said platen.

17. The inkjet recording apparatus according to claim 16, said ink absorbing member is a rotatable cylindrical member, said rotatable cylindrical member being rotated when it is brought into contact with said nozzles for cleaning.

18. The inkjet recording apparatus according to claim 16, further comprising:

a cleaning member which contacts the circumferential surface of the cylindrical body to remove the ink applied to the circumferential surface of said cylindrical body; and a moving mechanism that moves said cleaning member between a contact position where the cleaning member contacts the circumferential surface of said cylindrical body and a retracted position where said cleaning member is spaced from the circumferential surface of said cylindrical body, said cleaning member being moved by said moving mechanism to the retracted position so as not to interfere with said ink absorbing member when said cylindrical body is rotated.

19. The inkjet recording apparatus according to claim 11, wherein said at least one inkjet head includes a plurality of inkjet heads, and wherein said at least one platen includes the plurality of platens respectively corresponding to the plurality of inkjet heads.

20. The inkjet recording apparatus according to claim 19, wherein said plurality of inkjet heads eject the inks having different colors, respectively.

21. The inkjet recording apparatus according to claim 11, further comprising a blade member that extends in the axial direction of said cylindrical body and contacts the circumferential surface of said cylindrical body to scrape the ink applied thereon.

22. The inkjet recording apparatus according to claim 21, further comprising a porous member that extends in the axial direction of said cylindrical body and contacts the circumferential surface of said cylindrical body to absorb the ink applied thereon.

23. The inkjet recording apparatus according to claim 22, wherein said blade member and said porous member are arranged in this order along a rotational direction of said cylindrical body, the residual ink which has not been scraped by said blade member being absorbed by said porous member.

24. The inkjet recording apparatus according to claim 22, wherein said platen is formed of electrically insulating material, and wherein a charging mechanism is provided to charge the platen so that the recording medium is attracted by said platen by electrostatic force.

* * * * *